United States Patent [19]

Bluhm

[11] 4,009,060

[45] Feb. 22, 1977

[54] PRIMER COMPOSITION FOR USE WITH EXPLOSIVE CHARGES

[75] Inventor: Harold F. Bluhm, Allentown, Pa.

[73] Assignee: Atlas Powder Company, Dallas, Tex.

[22] Filed: Sept. 12, 1975

[21] Appl. No.: 613,032

[52] U.S. Cl. ..... 149/93; 149/107

[51] Int. Cl.[2] ..... C06B 25/32; C06B 25/08

[58] Field of Search ..... 149/93, 106, 107, 111

[56] References Cited

UNITED STATES PATENTS

| | | | |
|---|---|---|---|
| 2,353,147 | 7/1944 | Cook | 149/93 |
| 2,384,730 | 9/1945 | Davis | 149/93 |
| 2,407,595 | 9/1946 | Williams | 149/93 |
| 2,407,597 | 9/1946 | Wright | 149/93 |
| 2,471,851 | 5/1949 | Wright | 149/107 |
| 3,754,061 | 8/1973 | Forrest | 149/93 |

FOREIGN PATENTS OR APPLICATIONS

| | | |
|---|---|---|
| 481,223 | 2/1952 | Canada |
| 485,635 | 8/1952 | Canada |

*Primary Examiner*—Samuel W. Engle
*Assistant Examiner*—Donald P. Walsh
*Attorney, Agent, or Firm*—Connolly and Hutz

[57] ABSTRACT

The present invention relates to a primer composition formed of TNT, DNT (2,4-dinitrotoluene) and fine particle size PETN (pentaerythritol tetranitrate) for use with explosive charges. This composition is extruded in melt condition into primer cartridges. Any topping-off operations are eliminated since practically no shrinkage occurs as the melt cools to form a solid casting in the cartridge.

9 Claims, 6 Drawing Figures

PRIMER COMPOSITION FOR USE WITH EXPLOSIVE CHARGES

BACKGROUND OF THE INVENTION

There is a need in the explosive industry for small primers containing from 5–25 grams and even higher amounts of explosive material which is sensitive to a No. 6 cap as well as to detonating cord. Primers of this type must have sufficient physical strength, reliability and stability to be used as an extension of cap or detonating cord initiation system. Explosives, cast in a hot melt condition, and molds have been used and are being used today for this purpose. In some cases, the molds also serve as the package for the primer material.

A castable sensitive composition known as pentolite has long been used to prepare the larger sized primers. In some cases, pentolite has been used to prepare primers of very small design. The most commonly used pentolite is a blend of 50% TNT and 50% PETN. This is known as 50/50 pentolite. When heated to the melting point of the TNT (ca. 80.4° C.), and above, the pentolite mixture is a fluid slurry of molten TNT with a large portion of insoluble coarse granular PETN in suspension. Rapid stirring is required to maintain the solid PETN in even suspension. Pentolite is usually cast at a temperature in the range of 90°–100° C. and when casting such pentolite the solid coarse PETN has a tendency to settle out, resulting in a higher concentration of PETN at the bottom of the mold. This condition leads to excessively high sensitivity in the area of high PETN concentration and low sensitivity in the area of low PETN concentration.

In addition, castings made of pentolite shrink excessively on cooling. Shrinkage usually results in a large conical surface cavity that must be filled in with a second topping-off with poured hot melt pentolite to fill the mold. With larger castings, several pourings may be necessary. Even with a casting weighing only 5 grams, topping-off is required.

Another difficulty in using pentolite is due to the fact that the melt solidifies or fudges quickly upon contact with colder surfaces. This property makes it difficult to fill molds completely as large void spaces are frequently entrapped in the casting, especially if the casting is small and of complicated design.

Pentolite is normally hand poured or valved from a hot melt tank. In each case, the melt must be agitated rather rapidly to keep the coarse granular PETN in suspension. Blockage by granular PETN can be a problem in feed systems. When blockage does occur in a valve or pump, the hazard of inadvertent dentonation is present due to the sensitivity of PETN to crushing impact and friction.

The above disadvantages apply to pentolite which is made by adding coarse granular PETN to molten TNT, adding coarse granular PETN to molten TNT suspended in water and cooled to produce granular pentolite, or coprecipitating PETN and TNT from an acetone solution poured into water.

In summary, the problems associated with the use of 50/50 pentolite are:

1. rapid solidification
2. settling of coarse granular PETN
3. hazards associated with high concentration of granular PETN in melting tanks, pumps, valves and pipes
4. shrinkage

DESCRIPTION OF THE INVENTION

The present invention eliminates the need for hand casting the explosive melt material as well as the required topping-off which is a separate operation as costly as the original initial casting operation. With the use of the composition to be described both large and small primers can be automatically or hand filled in a one-step process without encountering severe shrinkage of the primer composition.

Figure 1:
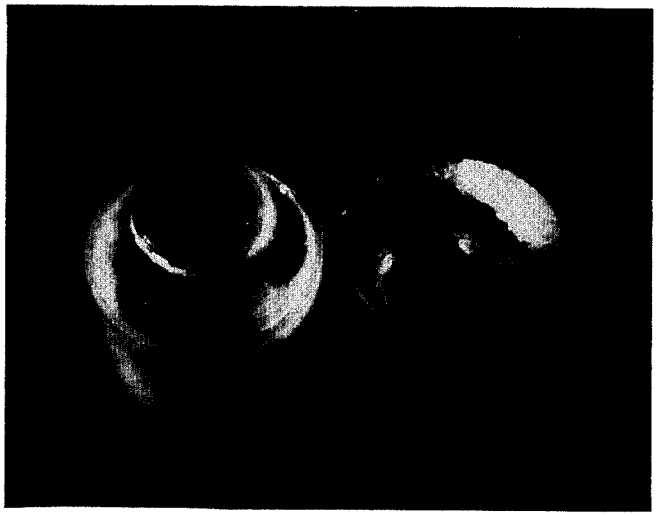
FIG. 1 is a pictorial view showing primer cartridges filled with 50/50 pentolite illustrating the shrinkage factor of the pentolite.
Figure 2:
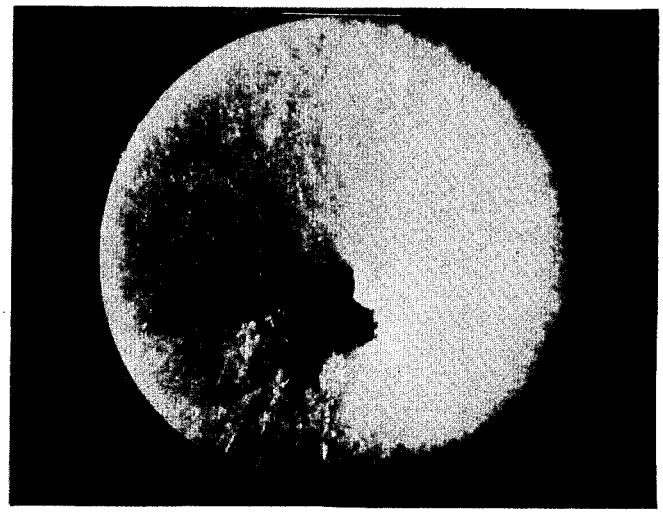
FIG. 2 is a top view of a larger diameter primer cartridge filled with 50/50 pentolite which also illustrates the shrinkage factor of the pentolite.
Figure 3:
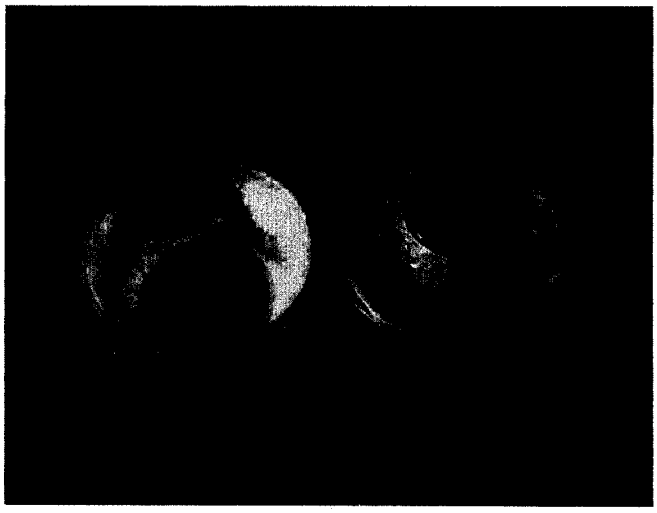
FIG. 3 is a pictorial view of the primer cartridge filled with the composition of the present invention but substituting coarse PETN used in pentolite for the fine PETN used in the present invention and illustrating the shrinkage factor of this composition.

As mentioned above, the 50/50 pentolite undergoes shrinkage as it cools after being extruded or otherwise deposited in melt condition in a single loading step into a primer cartridge. This shrinkage factor is illustrated by FIGS. 1 and 2 which show cavities and depressions in the top surface of the material after the pentolite has cooled and solidified. FIG. 1 illustrates the shrinkage factor with the use of cartridges of ⅝ inch I.D. × 2 inches long while FIG. 3 illustrates the shrinkage factor with a cartridge of 1¾ inch I.D. × 1 inch deep.

The present invention avoids the problems discussed above with the use of 50/50 pentolite by using a melt blend of TNT mp. of about 80° C. and DNT mp. of about 69° C. Proper melt blends of these two compounds can have a solidification temperature below that of either compound in the pure condition. For example, 50% DNT and 50% TNT melts at about 46° C.; 20% DNT and 80% TNT melts at about 67° C. The 50/50 DNT/TNT composition is said to be a eutectic. These melt blends have a tendency to soft fudge and remain mobile during cooling before final solidification and to form smaller crystals. Thus, a melt blend is used as the vehicle to carry the PETN in the present composition. A weight ratio of 20% DNT and 80% TNT is preferred. Rapid solidification which was a primary problem with the 50/50 pentolite compositions is avoided with the use of the present melt blend of TNT and DNT.

Figure 4:
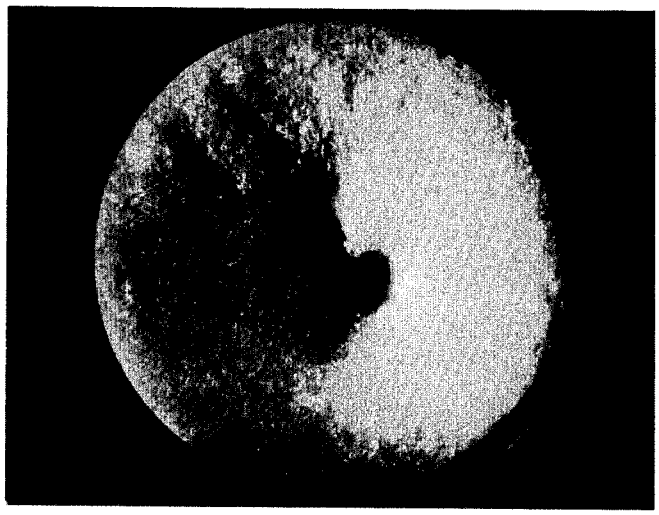
FIG. 4 is a top view of a larger diameter primer cartridge using the same composition as used with the cartridge of FIG. 3 and illustrating the shrinkage factor of this composition.
Figure 5:
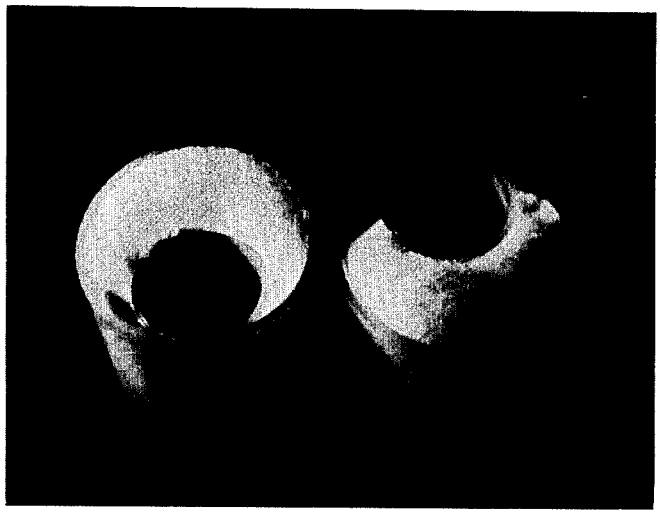
FIG. 5 is a pictorial view of primer cartridges filled with the composition of the present invention and illustrates the relative absence of shrinkage of the composition.
Figure 6:
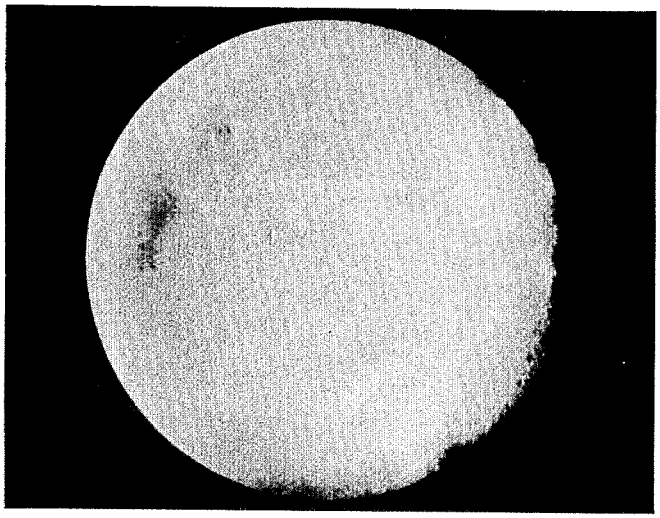
FIG. 6 is a top view of a larger diameter primer cartridge filled with the composition of the present invention which also illustrates the relative absence of shrinkage of the composition.

Further, to avoid the settling of the granulated PETN which is a disadvantage with the 50/50 pentolite the compositions of the present invention incorporate finely granulated PETN of approximately 120–150 mesh rather than the coarse type used in 50/50 pentolite. The particle size of the PETN is further reduced because of its partial solubility in a hot DNT-TNT melt. The advantage of using fine PETN is illustrated by FIGS. 3–6 wherein FIGS. 3 and 4 illustrate a composition of 40% TNT, 10% DNT and 50% PETN with the use of coarse PETN and FIGS. 5 and 6 illustrate the compositions of the present invention using 40% TNT, 10% DNT and 50% fine PETN. As seen in FIGS. 3 and 4 the cooled and solidified composition after a one-step filling operation show shrinkage and caviation but not as much as shown in FIGS. 1 and 2. FIGS. 5 and 6 on the other hand show practically no shrinkage after a one-step filling operation. The surface of the composition of the present invention shown in FIGS. 5 and 6 is convex and the depressions seen in FIG. 5 in the corners of the small primers were present immediately after the cartridges were filled. The cartridge dimensions of FIGS. 3 and 5 are the same as those of FIG. 1 and the dimensions of the cartridges of FIGS. 4 and 6 are the same as those of FIG. 2.

DETAILS OF THE INVENTION

The following example serves to illustrate the invention.

1. A mixture of 50% finely granulated PETN, 10% DNT and 40% TNT was formed by heating the components together with agitation to a temperature of 90°–100° C. to form a melt. This melt had a smooth, creamy texture and there was little tendency for the PETN to settle out. Only a very mild agitation or movement was required to maintain a homogeneous mixture. The composition showed virtually no shrinkage even in the largest castings made which weighed 50 grams. A topping-off operation was not required even in the larger castings. The creamy consistency of this composition was capable of being valved with a pinch type clamp, plug stick or check valve. Elastomeric or rigid plastic was used to reduce hazard. The blend referred to showed no tendency for the fine PETN to accumulate in or at such devices. The fine PETN was mobile in its cream base and was squeezed smoothly from in between such contact surfaces. The same blend was used in a 10 cc plastic syringe (heated to 95° C.) to inject the composition through a 3/32 I.D. × ½ inch long tube. This method was used to fill hundreds of plastic cartridges of complex shape to the full level in one operation. Blockage at the injection nozzle never occurred.

As will be evident to those skilled in the art, various modifications can be made or followed in light of the foregoing disclosure and discussion, without departing from the spirit or scope of the claims.

What is claimed is:

1. A homogeneous primer composition of uniform sensitivity for use with explosive charges consisting of about 50% by weight of the total composition of a nitrotoluene blend of 20–50%, dinitrotoluene (DNT) having a melting point of about 69° C. with 50–80% of trinitrotoluene of about 80° C., and about 50% of the total composition of finely granulated pentaerythritol tetranitrate (PETN) of 120–150 mesh size which remains in suspension in the nitrotoluene blend after being mixed with the nitrotoluene blend.

2. The primer composition of claim 1 wherein the blend is formed of 20–50% DNT and 50–80% TNT.

3. The primer composition of claim 1 wherein the blend is formed of 20% DNT and 80% TNT.

4. The primer composition of claim 1 wherein the composition is formed of 50% fine PETN of 120–150 mesh, 10% DNT and 40% TNT by weight of the total composition.

5. A primer unit for use with explosive charges comprising a hollow cartridge and a solidified homogeneous explosive composition of uniform sensitivity within said cartridge wherein said composition consists of about 50% by weight of the total composition of a nitrotoluene blend of 20–50% dinitrotoluene (DNT) having a melting point of about 69° C. with 50–80% of trinitrotoluene having a melting point of about 80° C, and about 50% of the total composition of finely granulated pentaerythritol tetranitrate (PETN) of 120–150 mesh size which is uniformly suspended in the nitrotoluene blend.

6. The primer unit of claim 5 wherein the blend is formed of 20–50% DNT and 50–80% TNT.

7. The primer unit of claim 5 wherein the blend is formed of 20% DNT and 80% TNT.

8. The primer unit of claim 5 wherein the composition is formed of 50% fine PETN of 120–150 mesh, 10% DNT and 40% TNT, by weight of the total composition.

9. A primer composition of uniform sensitivity for use with explosive charges consisting of a nitrotoluene blend of 20–50%, dinitrotoluene (DNT) having a melting point of about 69° C. with 50–80% of trinitrotoluene having a melting point of about 80° C., and finely granulated pentaerythritol tetranitrate (PETN) of 120–150 mesh size which remains in suspension in the nitrotoluene blend after being mixed with the nitrotoluene blend.

* * * * *